US006247707B1

(12) United States Patent
Conte

(10) Patent No.: US 6,247,707 B1
(45) Date of Patent: Jun. 19, 2001

(54) IN-LINE ROLLER SKATE

(75) Inventor: Gino Conte, Caerano San Marco (IT)

(73) Assignee: Roces S.R.L. (IT)

( * ) Notice: Subject to any disclaimer, the term of this patent is extended or adjusted under 35 U.S.C. 154(b) by 0 days.

(21) Appl. No.: 09/303,351

(22) Filed: Apr. 30, 1999

(30) Foreign Application Priority Data

May 6, 1998 (IT) ..... MI98A0981

(51) Int. Cl.[7] ..... A63C 1/00; A63C 17/00

(52) U.S. Cl. ..... 280/11.221; 280/11.26; 280/11.27; 280/7.13

(58) Field of Search ..... 280/11.22, 11.26, 280/11.27, 11.32, 11.34, 7.14, 7.13, 600, 633, 634, 11.16

(56) References Cited

U.S. PATENT DOCUMENTS

| | | | | |
|---|---|---|---|---|
| 2,015,569 | * | 9/1935 | Pomeroy | 280/7.13 |
| 3,635,854 | * | 1/1972 | Martin | 280/7.13 |
| 5,484,149 | * | 1/1996 | Lee | 280/11.26 |
| 5,498,009 | * | 3/1996 | Young | 280/11.26 |
| 5,645,288 | * | 7/1997 | Lu | 280/11.26 |
| 5,842,293 | * | 12/1998 | Young | 280/11.26 |
| 6,045,144 | * | 4/2000 | Wong | 280/11.26 |
| 6,050,574 | * | 4/2000 | Olson et al. | 280/11.22 |

* cited by examiner

*Primary Examiner*—Michael Mar
*Assistant Examiner*—Hau Phan
(74) *Attorney, Agent, or Firm*—R. Neil Sudol; Henry D. Coleman

(57) ABSTRACT

An in-line roller skate of the type which includes a shell with a support for the wheels and a quarter which is slidingly associated with the shell. Struts for the selective axial movement of the quarter is associated with the shell of the skate.

11 Claims, 2 Drawing Sheets

IN-LINE ROLLER SKATE

BACKGROUND OF THE INVENTION

1. Field of the Invention

The present invention relates to an in-line roller skate.

2. Description of the Prior Art

In-line roller skates are generally constituted by a support, which is usually shaped as an inverted U and is associated with a boot.

These conventional skates have drawbacks: first of all there is the problem of providing boots having different sizes according to the different foot sizes, both at the production stage and in stock.

On the one hand, this leads to the production of a limited number of sizes, and this usually forces the user to purchase a size which is not suitable for the specific dimensions of his foot, resorting to contrived remedies, such as the use of a thick sock, to increase comfort whilst trying to occupy the excess space, so as to be able to transmit the efforts of the foot to the skate in an optimum manner.

Italian Patent No. 1,257,603, in the name of this same Applicant, discloses an in-line roller skate comprising a shell which is monolithic with a support for the wheels and is open in an upward region and to the rear; a quarter and a tongue are slidingly and selectively associated with the shell, to the rear and in an upward region respectively, and the quarter has, to the rear, a grip means for the user. The skate includes a brake which is associated by snap action with a frame which is associated with the support.

The above skate has an engagement means which is constituted by two first seats formed longitudinally at the lower surface of the quarter. The selective connection between the quarter and the shell occurs by virtue of first holes which are formed at the lateral surface of the shell and with which second holes, formed laterally to the lateral surface of the shell, can be made to interact so that the first and second holes have, depending on the longitudinal movement applied to the quarter toward the shell, the same axis, so as to allow mutual coupling by virtue of studs.

This skate too has drawbacks, since size adjustment is not easy because it is necessary to act manually on the various components in order to achieve an intended mutual positioning, which in any case is not always optimum, since it is necessary to make the holes overlap and it is therefore possible to choose among various positions which, however, are discrete and not continuous.

SUMMARY OF THE INVENTION

An aim of the present invention is to solve the mentioned technical problems, eliminating the drawbacks in the cited prior art by providing an in-line roller skate in which it is possible to continuously and precisely vary the size of the roller skate in order to adapt it to the specific anatomical requirements of the individual user.

An object is to provide and in-line roller skate in which the adjustment can be achieved quickly and easily by the skater.

This aim, this object and others which will become apparent hereinafter, are achieved by an in-line roller skate as claimed in the appended claims.

Other objects will become apparent during the following description, which must be considered together with the accompanying drawings, which illustrate a particular embodiment by way of nonlimitative example and in which:

DESCRIPTION OF THE PREFERRED EMBODIMENT OF THE INVENTION

Figure 1:
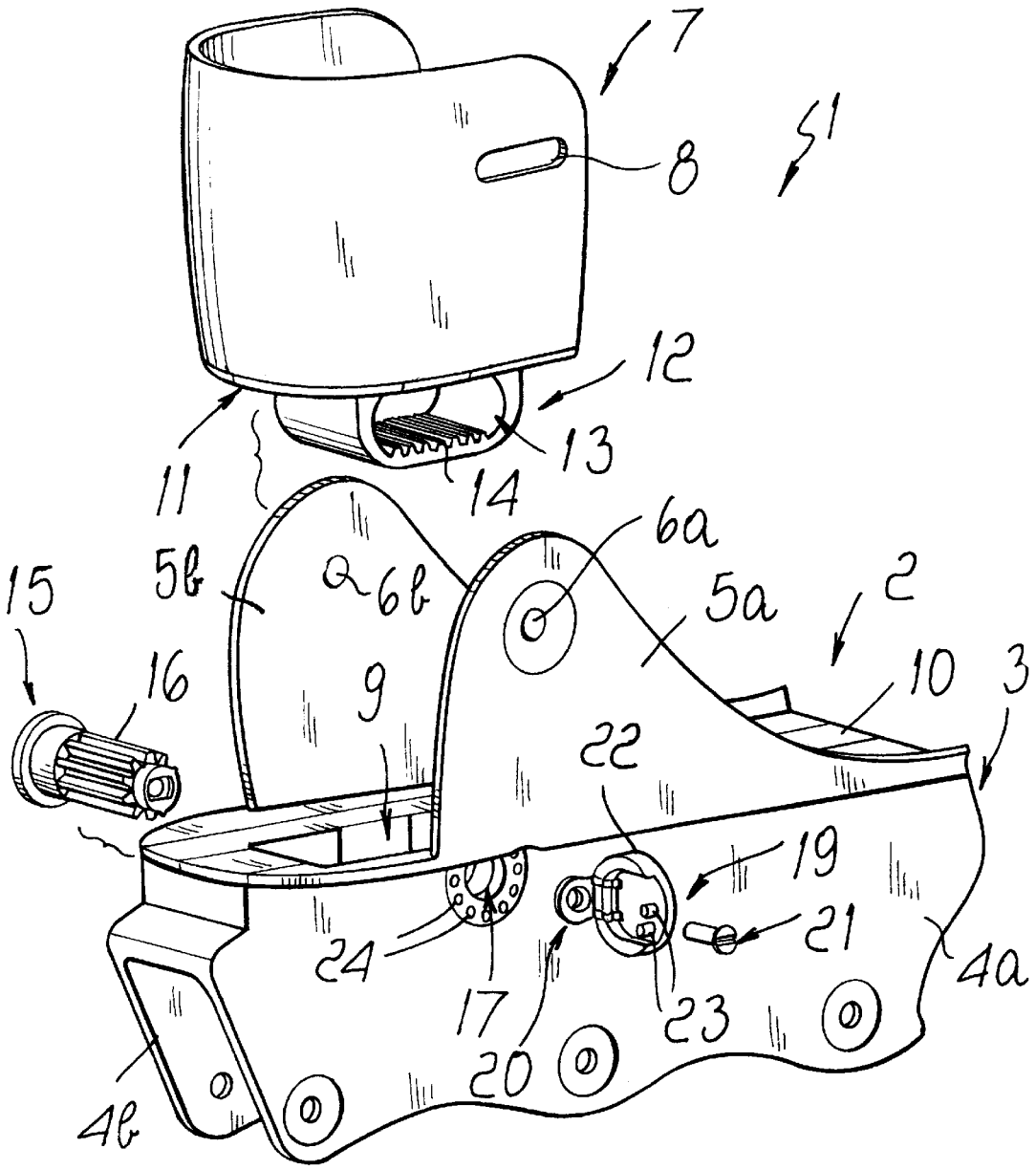
FIG. 1 is a partial exploded side perspective view of the components of the roller skate.
Figure 3:
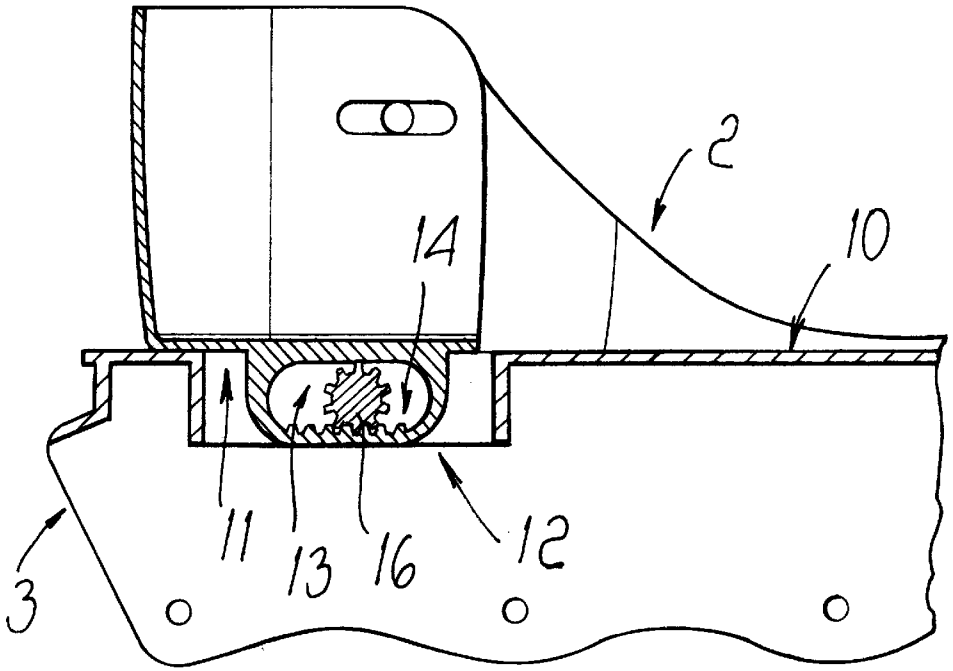
FIG. 3 is a longitudinal cross section view of the roller skate, taken along a transverse plane which passes through the means for the selective axial movement of the quarter.
Figure 2:
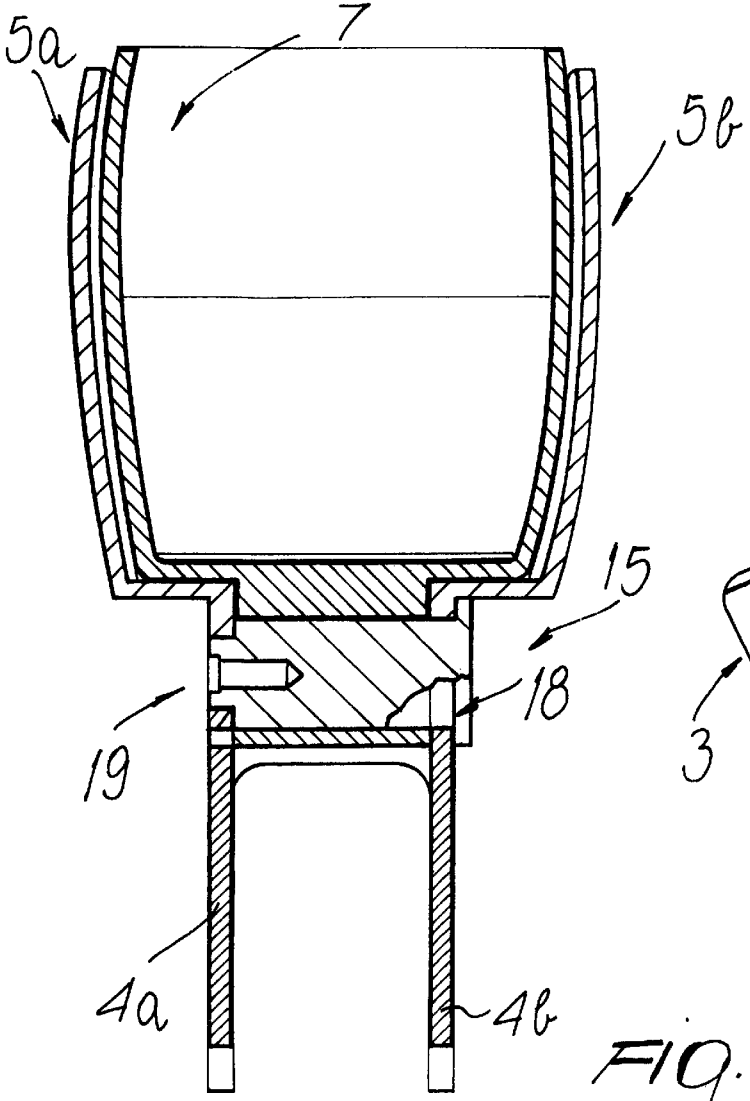
FIG. 2 is a sectional view of the roller skate, taken along a longitudinal median plane.

With reference to the above figures, and bearing in mind that they are examples of a particular embodiment and are in variable scale and that individual reference numerals designate identical or equivalent parts in the drawings, the numeral 1 designates the roller skate, which includes a shell 2 which is formed monolithically with an underlying support 3. Support 3 is shaped as an inverted U and has wings 4*a* and 4*b* supporting a plurality of mutually in-line wheels, not shown.

The shell 2 has two first tabs 5*a* and 5*b,* to the rear and at the malleolar region. Each tab 5*a* 5*b* has a first hole 6*a* and 6*b,* which has the same sliding connection axis for a quarter 7.

Pivots or rivets are arranged at the first holes and lie at two slots 8 which are formed laterally to the quarter and are arranged along an axis which is longitudinal with respect to the support 3.

A means or adjustment mechanism for the selective axial movement of the quarter 7 is associated with the shell and is constituted by a first seat 9 which is formed axially at the base 10, shared with the shell 2, of the support 3, at which the lower surface 11 of the quarter 7 is slidingly rested.

The means for the selective axial movement of the quarter 7 also comprises a second tab 12 which protrudes below the lower surface 11 of the quarter 7 and can be slidingly arranged at the first seat 9 formed in the base 10 of the support 3.

The second tab 12 is approximately as wide as the first seat 9 and shorter than the seat, so as to allow the axial movement of the quarter 7.

In a longitudinal cross-section, the second tab 12 has an oval shape, and a second seat 13 is formed transversely thereto. A set of teeth 14, arranged transversely to the second tab 12, is formed on at least one surface at the second seat.

An additional component of the means for the selective axial movement of the quarter can be arranged within the second seat 13. The component is constituted by a wheel 15 which has a stem 16 which is toothed complementarily to the set of teeth 14 and can be arranged transversely to the support 3. The wheel 15 is pivoted at its ends, so as to be able to rotate freely, at a second hole 17 and third hole 18 which are formed respectively in the wing 4*a* and in the wing 4*b* of the support 3, the second and third holes having the same axis.

The wheel 15 is moved by virtue of a lever 19 which is constituted for example by a third tab 20 which can be keyed at the shaft of the stem 16 and the wheel 15 by means of a screw 21.

The clockwise or counterclockwise rotation of the third tab 20 is also facilitated by a fourth tab 22 which is stably or rotatably connected to the third tab 20 so as to optionally close onto it.

In order to maintain the intended position, there is also a retention means, such as for example teeth 23 which protrude from the fourth tab 22, which can selectively engage for example at fourth holes 24 formed in the wing 4*a* of the support 3 in a region which is adjacent to the second hole 17.

The use of the invention is therefore as follows: once the quarter has been fitted to the support 3, the user can disengage the teeth 23 from the fourth holes 24 and then grip the fourth tab 22, so as to force a clockwise or counter-clockwise rotation of the wheel 15.

In this manner, the stem 16 forces the axial movement of the second tab 12 and therefore of the quarter 7 with respect to the shell or support.

The user can thus achieve a fine variation of the position of the quarter with respect to the shell according to the specific requirements.

It has thus been found that the illustrated solution achieves the intended aim and object, since a skate has been provided in which it is possible to continuously and precisely vary the size of the skate, adapting it to the specific anatomical requirements of the individual user.

Furthermore, adjustment of the position by virtue of the wheel 15 can be achieved quickly and easily by the skater without requiring particular tools or having to disassemble any part that constitutes the skate.

The skate according to the invention is susceptible of numerous modifications and variations, within the scope of the appended claims.

The materials and the dimensions that constitute the individual components of the skate, such as for example the number of first or second holes, may of course vary according to the specific requirements.

What is claimed is:

1. An in-line roller skate, comprising:

a shell;

a support for a plurality of wheels;

a quarter which is slidingly associated with said shell; and sliding means for the selective axial movement of said quarter with respect of said shell, said shell being formed monolithically with said support, said support being shaped in the form of an inverted U and being adapted to support a plurality of wheels, said shell having in a rear part two first tabs provided with respective holes which have a common axis, said quarter being provided laterally with two slots, pivot members traversing respective ones of said holes and respective ones of said slots, said sliding means comprising a seat which is formed axially at a common base of said shell and said support, said quarter having a lower flat surface slidingly resting at said common base, said sliding means further comprising a second tab which protrudes from said quarter and below said lower flat surface of said quarter, said second tab being slidingly arranged at said seat formed in said common base of said shell and said support, said second tab being approximately as wide as said seat and shorter than said seat, so as to allow a movement of said quarter relative to said shell and said support, said second tab having, in a longitudinal cross-section, an oval shape, said seat being a first seat, a second seat being formed in said second tab transversely thereto, a set of teeth arranged transversely to said second tab being formed at said second seat on at least one surface of said second tab.

2. The skate according to claim 1, wherein an additional component of said sliding means is arranged within said second seat, said additional component including at least one wheel having a stem which is toothed complementarily to said set of teeth and can be arranged transversely to said support.

3. The skate according to claim 2, wherein said holes are first holes and wherein said support includes a pair of generally parallel wings, said one wheel being, at its ends, movably mounted in second and third holes formed respectively in said wings of said support, said second and third holes having a common axis.

4. The skate according to claim 3, wherein movement is applied to said one wheel by means of a lever which can be gripped by the user.

5. The skate according to claim 4, wherein said lever includes a tab keyed at an end of said stem by means of a screw.

6. The skate according to claim 5, wherein a rotation of said third tab is assisted by a fourth tab which is connected to said third tab, so as to optionally close onto said third tab.

7. The skate according to claim 6, further comprising retention means which protrude from said fourth tab and which can be selectively engaged at fourth holes formed in one of said wings of said support in a region which is adjacent to said second hole.

8. An in-line roller skate, comprising:

a shell;

a support for a plurality of wheels, said shell being formed monolithically with said support;

a quarter which is slidingly associated with said shell; and an adjustment mechanism for axial positioning said quarter with respect to said shell, one of said shell and said quarter being laterally provided with aligned circular holes, the other of said shell and said quarter being laterally provided with two aligned slots, said holes being juxtaposed to and aligned with respective ones of said slots, thereby enabling a sliding of said quarter relative to said shell and said support member, pivot members traversing respective ones of said holes and respective ones of said slots, said shell and said support having a common base provided with a seat, said quarter having a lower flat surface slidingly resting at said common base, said adjustment mechanism including a tab which protrudes from said quarter and below said lower flat surface of said quarter, said tabs protruding through said seat, said tab being approximately as wide as said seat and shorter than said seat, so as to allow a movement of said quarter relative to said shell and said support, said tab having, in a longitudinal cross-section, an oval shape, said seat being a first seat, a second seat being formed in said tab transversely thereto, a set of teeth arranged transversely to said tab being formed at said second seat on at least one surface of said tab.

9. The skate according to claim 8, wherein an additional component of said adjustment mechanism is arranged within said second seat, said additional component including at least one wheel having a stem which is toothed complementarily to said set of teeth and can be arranged transversely to said support.

10. The skate according to claim 9, wherein said holes are first holes and wherein said support includes a pair of generally parallel wings, said one wheel being, at its ends, pivotably or rotatably mounted in second aligned holes formed in said wings of said support, said second aligned holes having a common axis.

11. The skate according to claim 10, wherein movement is applied to said one wheel by means of a lever which can be gripped by the user.

* * * * *